US005423729A

United States Patent [19]

Eschenbach

[11] Patent Number: 5,423,729

[45] Date of Patent: Jun. 13, 1995

[54] COLLAPSIBLE EXERCISE MACHINE WITH ARM EXERCISE

[76] Inventor: Paul W. Eschenbach, 143 Lakeland Ave., Moore, S.C. 29369

[21] Appl. No.: 283,562

[22] Filed: Aug. 1, 1994

[51] Int. Cl.[6] ..... A63B 69/16; A63B 22/04

[52] U.S. Cl. ..... 482/70; 482/51; 482/57

[58] Field of Search ..... 482/51, 52, 57, 70, 482/71, 62, 111, 72, 60

[56] References Cited

U.S. PATENT DOCUMENTS

| | | | |
|---|---|---|---|
| 219,439 | 9/1879 | Blend | 482/70 |
| 4,786,050 | 11/1988 | Geschwender | 482/57 |
| 5,149,312 | 9/1992 | Croft et al. | 482/62 |
| 5,242,343 | 9/1993 | Miller | 482/57 |
| 5,290,211 | 3/1994 | Stearns | 482/70 |
| 5,352,169 | 10/1994 | Eschenbach | 482/57 |

*Primary Examiner*—Stephen R. Crow

[57] ABSTRACT

An exercise apparatus having a collapsible frame that simulates running and climbing depending upon where the foot is positioned along the elongate pedal. The user is able to maintain a standing posture while elongate pedals supporting each foot move through an exercise cycle having a different mode for each foot position that includes translating and non-parallel angular motion generated by a linkage mechanism. Arm exercise is provided by rocker extensions which are phased with the crank to use arm force for moving the crank through dead center positions.

19 Claims, 6 Drawing Sheets

COLLAPSIBLE EXERCISE MACHINE WITH ARM EXERCISE

BACKGROUND OF THE INVENTION

1. Field

The present invention relates to an exercise apparatus that simulates running and climbing. More particularly, the present invention relates to an exercise machine having separately supported elongate pedals exhibiting programmed motion in conjunction with a collapsible frame and arm exercise.

2. State of the Art

The benefits of regular exercise to improve overall health, appearance and longevity are well documented in the literature. For exercise enthusiasts the search continues for a safe apparatus that provides maximum benefit in minimum time which can be stowed when not in use.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance change over many minutes of cycling and a clever display to capture the attention of the user. However, the issue of extensive time, limited muscle usage and collapsibility for stowage are not fully addressed.

In recent years, stair climbers have become very popular due to the higher loading possible with stand-up exercise as well as different muscles used compared to sit-down cycling. The Stairmaster U.S. Pat. No. 4,708,338 is one of the most popular stairclimbers allowing up and down independent parallel foot pedal movement with programmed load variation over multiple cycles as well as a clever display to hold the attention of the user. Other stairclimbers U.S. Pat. Nos. 4,989,858 and 5,013,031 provide reciprocating foot motion but with non-parallel pedal control and differing load resistance systems.

Another group of stair climbers U.S. Pat. Nos. 4,687,195, 4,726,581 and 4,927,136 have moving stairs requiring the user to remove the foot from each stair after the down stroke. While this foot motion is more diverse than the reciprocating motion of most stair climbers, the issue of operator safety requires complex solutions for practical apparatus.

Stand-up pedaling approaches the the benefits of running to the cardiovascular system because a higher load resistance is possible over sit down cycling. Dr. Cooper in his book entitled THE AEROBICS PROGRAM FOR TOTAL WELL-BEING by Dr. Kenneth H. Cooper, Bantam Books, New York, 1982 awards only half the benefit points to sit-down stationary cycling (page 260) over regular cycling which includes an equal amount of uphill and downhill course (page 255). Dr. Cooper grades running better than regular cycling, but without the downhill rest inherent in regular cycling, it is certain that stand-up pedaling would be equivalent to running for cardiovascular benefits in less time.

Stand-up cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe stand-up cycling with free pedals in a lift mode to simulate body lifting after the lower dead center pedal position to the other pedal in the higher position. A brake or clutch system is deployed to load or stop the lower pedal while the weight is transferred to the other pedal after the crank has passed through the dead center position. All of these stand-up cycling patents mentioned use free pedals which are free to rotate about one pivot point on the crank. Stand-up pedaling is safer when the free pedal is fully constrained to become a platform capable of providing body balance on one foot with minimal hand support.

An attempt to stabilize the pedal using a linkage is shown by Boyd in U.S. Pat. No. 1,323,004 with his mechanism for propelling bicycles. A lever is applied to the pedal to increase the mechanical advantage of the crank during the power stroke. The weight of the body is supported by the ball of the foot only and the lower most position of the pedal shows a severe incline (see Boyd FIG. 3). Boyd does not address the pedal positions necessary for for stand-up pedaling which simulate running. Geschwender in U.S. Pat. No. 4,786,050 shows a stand-up exercise machine where elongate pedals are supported by double rotating cranks. The pedal positions shown in FIGS. 2 and 3 do not anticipate pedal inclines needed to simulate running or climbing.

Parallel motion pedal constraint is shown in U.S. Pat. No. 4,643,419 (Hyde) where pulleys of the same size are coupled with a belt or chain to maintain a pedal platform horizontal or parallel to a base through a rotatable cycle of motion. Parallel pedal motion using a parallelogram linkage is shown in U.S. Pat. No. 4,708,338. Another popular stand-up exerciser is sold by Diversified Products of Opelika, Al. as the DP Air Strider. The Air Strider provides a pedal platform constrained by two equal length cranks which are coupled by a chain riding on equal diameter sprockets giving parallel horizontal pedal motion similar to Hyde. While parallel platforms help stabilize the balance of the user, the heel of the foot raises from the platform during operation when the knee is bent in the upper positions of pedal platform movement. The ankle ligaments and particularly the Achilles tendon are subjected to excessive stress when the heel is raised forcing all weight on that leg to be supported by the ball of the foot.

Eschenbach in U.S. Pat. No. 5,279,529 shows three different linkages suitable for stand-up exercise that fully support the toe and heel of the foot throughout a 360 degree pedal cycle. Miller in U.S. Pat. No. 5,242,343 shows several linkages for stand-up exercise where the elongate pedal has inclined reciprocating motion on the toe end of the pedal during a crank cycle. Neither Eschenbach nor Miller anticipate collapsibility of their stand-up exercise machines. Ruegsegger in U.S. Pat. No. 3,475.,021 shows a skier training device which has foldable pole handles that pivot about a base frame. However, the Ruegsegger device does not address a running or climbing pedal motion.

Iams and Splane in U.S. Pat. No. 5,038,758 show a collapsible framework useful for decompressing the spine and Hess in U.S. Pat. No. 5,279,530 shows a collapsible framework for lower back rehabilitation exercise. Neither Iams and Splane nor Hess address collapsibility for stand-up running or jogging exercise. Holzapfel in German Pat. No. 27 30892 shows a collapsible exercise machine to simulate a back and forth ski motion of the feet but does not address a framework for running or jogging exercise.

There is a need for an exercise machine that can be used in the stand-up mode that provides a stable pedal platform which inclines as the knee is bent thus obviating the need to raise the heel off the pedal platform whereby unwanted stress is removed from the ankle ligaments and from the Achilles tendon. There is a further need to provide a stand-up exercise machine that provides arm exercise and can be collapsed when not in use for easy stowage where floor space is scarce as in small apartments or college dorms.

SUMMARY OF THE INVENTION

The present invention relates to the kinematic motion control of elongated pedals which simulate running or climbing during operation and where the supporting frame is collapsible for easy stowage when not in use. More particularly, apparatus is provided that offers variable intensity exercise through a leg operated, cyclic motion mode of exercise in which the elongate pedal supporting each foot is guided through successive positions during the motion cycle while load resistance acts upon the crank mechanism.

The apparatus includes a separate elongate pedal having several foot positions for each foot, each partially supported by a rotary crank which normally completes one full revolution during a cycle and is phased approximately 180 degrees relative to the crank for the other elongate pedal through a bearing journal attached to the framework. The elongate pedals are constructed to be adjustable in length to facilitate collapsibility and are supported on the other end by rocker arms which are rotatably attached to an upright support that folds about a base frame. The crank, elongate pedal and rocker arm form a four-bar linkage known in the literature as a crankrocker mechanism where the elongate pedal is the coupler link.

The rocker arms extend upward above the pivot located on the upright support member to provide optional arm exercise during the running mode where the feet are located nearer the rocker arms. The upright support can be moved to more than one position to accommodate the user in other modes. A movable handlebar is also pivotally attached to the upright support member to provide upper body balance during the climbing mode when the feet are located nearer the crank end of the elongate pedal. The feet rise higher in the climbing mode than in the running mode.

The frame is made collapsible with the use of telescoping tubing being an integral part of the side support members. The frame is coupled using rotary joints whereby the crank journal housing is allowed to collapse when the tubing telescopes. Both elongate pedals become nearly parallel to the side support members after one pedal is shortened and the other lengthened to make the rocker arms generally parallel to the upright support member whereby the rocker arms and upright support member can be folded as an assembly about the base frame cross member. Load resistance is applied by a compact adjustable friction brake coupled to the crank and attached to the frame.

It will be appreciated that this embodiment using a friction brake does not require the momentum of a flywheel to carry the pedals through the dead center positions. When the crank is in the dead center positions, the rocker arms are in the middle of their swing range so that the forces provided by the arms of the user upon the rocker arm extensions impinges upon the pedal acting upon the crank to push or pull the crank through the dead center positions. Therefore, one-way clutches are not needed as a safety feature in this invention to prevent the flywheel motion from driving pedals when the user stops. With friction load resistance, the rotary crank stops almost immediately when the user discontinues the application of foot force. Without one-way clutches, the rotary crank can be driven in the reverse direction to exercise different muscles.

In summary, the application of positive non-parallel elongate pedal position control affords the benefits of a safer stand-up exercise apparatus having low ankle/Achilles tendon stress compared to parallel platform control. A collapsible handlebar, rocker arms and frame allow easy stowage when not in use.

DETAILED DESCRIPTION OF THE EMBODIMENT

Figure 1:
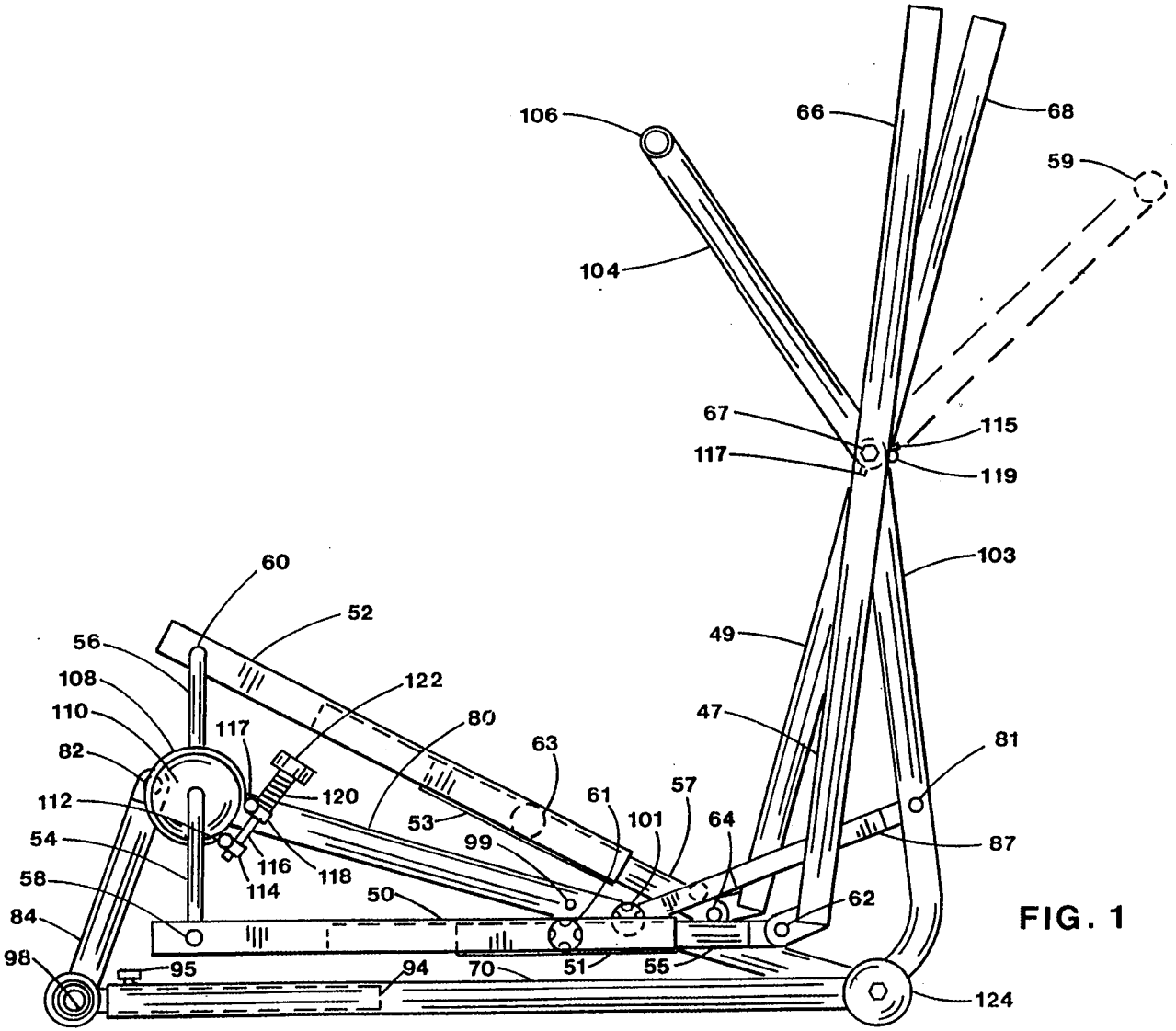
FIG. 1 is a right side elevation view of the preferred embodiment of an exercise machine constructed in accordance with the present invention.
Figure 2:
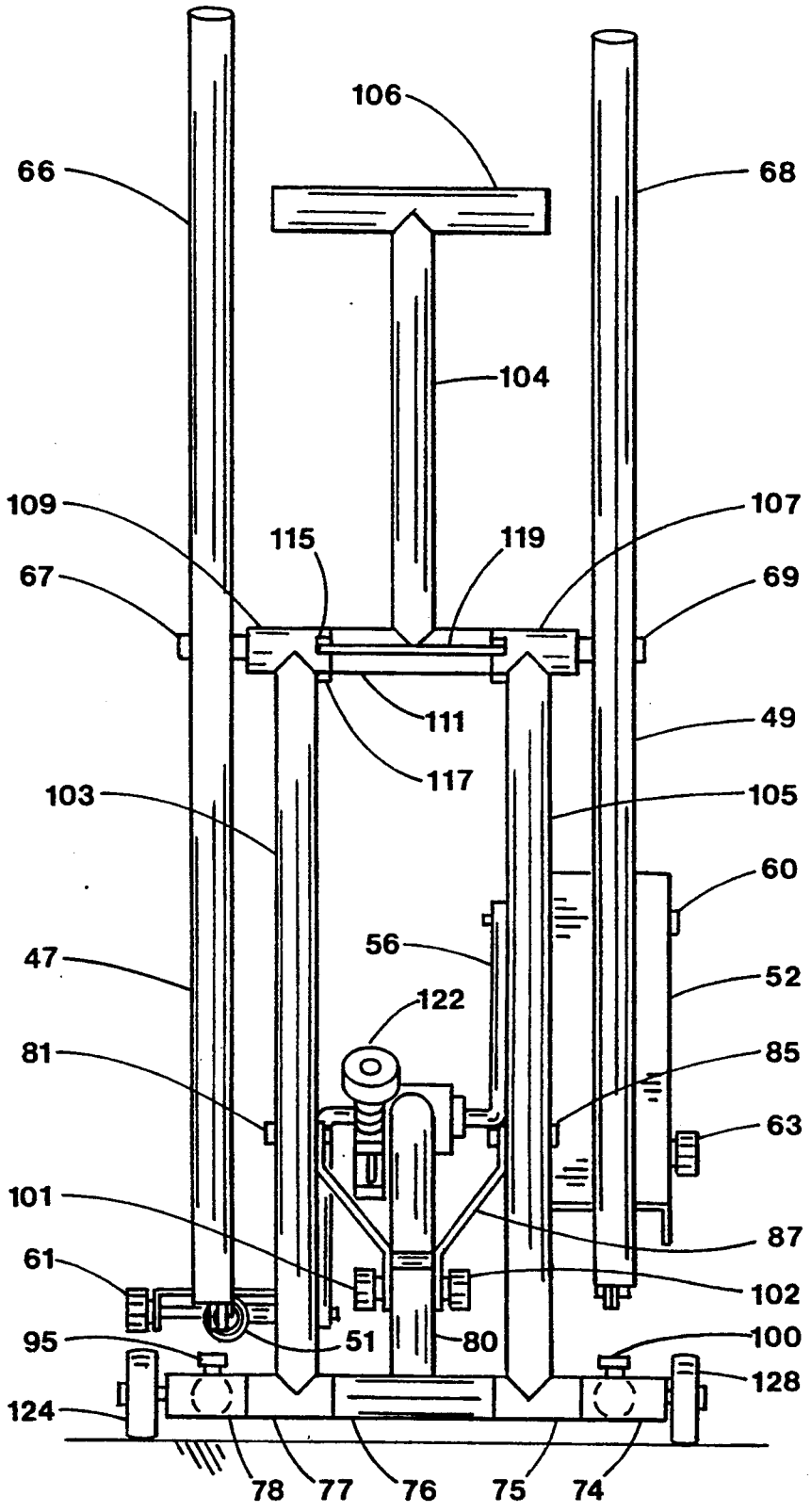
FIG. 2 is the front view of the preferred embodiment shown in FIG. 1.

Referring to the drawings in detail, elongate pedals 50 and 52 are shown in FIGS. 1 and 2 in the lowest and highest positions, respectively. Crank 54 is rotatably attached to pedal 50 by crank pin 58 while crank 56 is rotatably attached to pedal 52 by crank pin 60. Cranks 54 and 56 are connected by crankshaft journal 55 which is rotatably secured to bearing housing 83. Elongate pedals 50 and 52 are covered with non-slip material to ensure foot contact and have hollow pedal supports 51 and 53, respectively, attached under the pedals 50 and 52. Rod pedal supports 55 and 57 are telescopically connected to the hollow pedal supports 51 and 53 and secured by locking screws 61 and 63 respectively.

Rocker arms 47 and 49 are rotatably attached to rod pedal supports 55 and 57 with pin bushings 62 and 64 and rotatably attached to the upright support cross members 109 and 107 by pin bushings 67 and 69, respectively. Rocker arms 47 and 49 are extended upward beyond pin bushings 67 and 69 to provide arm exercise as rocker arm extensions 66 and 68. Upright support cross members 109 and 107 are welded to a smaller concentric tube 113 (not shown).

Handlebar 106 is welded to tubing 104 which is welded to handle pivot tubing 111. Handle pivot 111 is pivotally attached to the smaller concentric tube 113. Tab 119 is welded to pivot tubing 111 and normally is in contact with stop block 115 for hand support or with stop block 117 when rocker arm extensions 66 and 68 are used for arm exercise and handle 106 is moved out of the way to position 59.

Upright support tubing 103 and 105 are welded to upright cross member supports 109 and 107 on one end and welded to base cross member supports 77 and 75, respectively, on the other end. Base cross member supports 77 and 75 are pivotally mounted on a smaller concentric tubing 73 (not shown).

The upright supports 103 and 105 are held generally vertical during operation by upright support brace 87 which is pivotally attached 81 and 85 to the upright support members 103 and 105 on one end and secured to crank support tubing 80 by locking screws 101 and 102 on the other end during operation. Additional locking screw positions 99 on crank support tubing 80 allow the upright supports 103 and 105 relocation to other positions.

Figure 3:
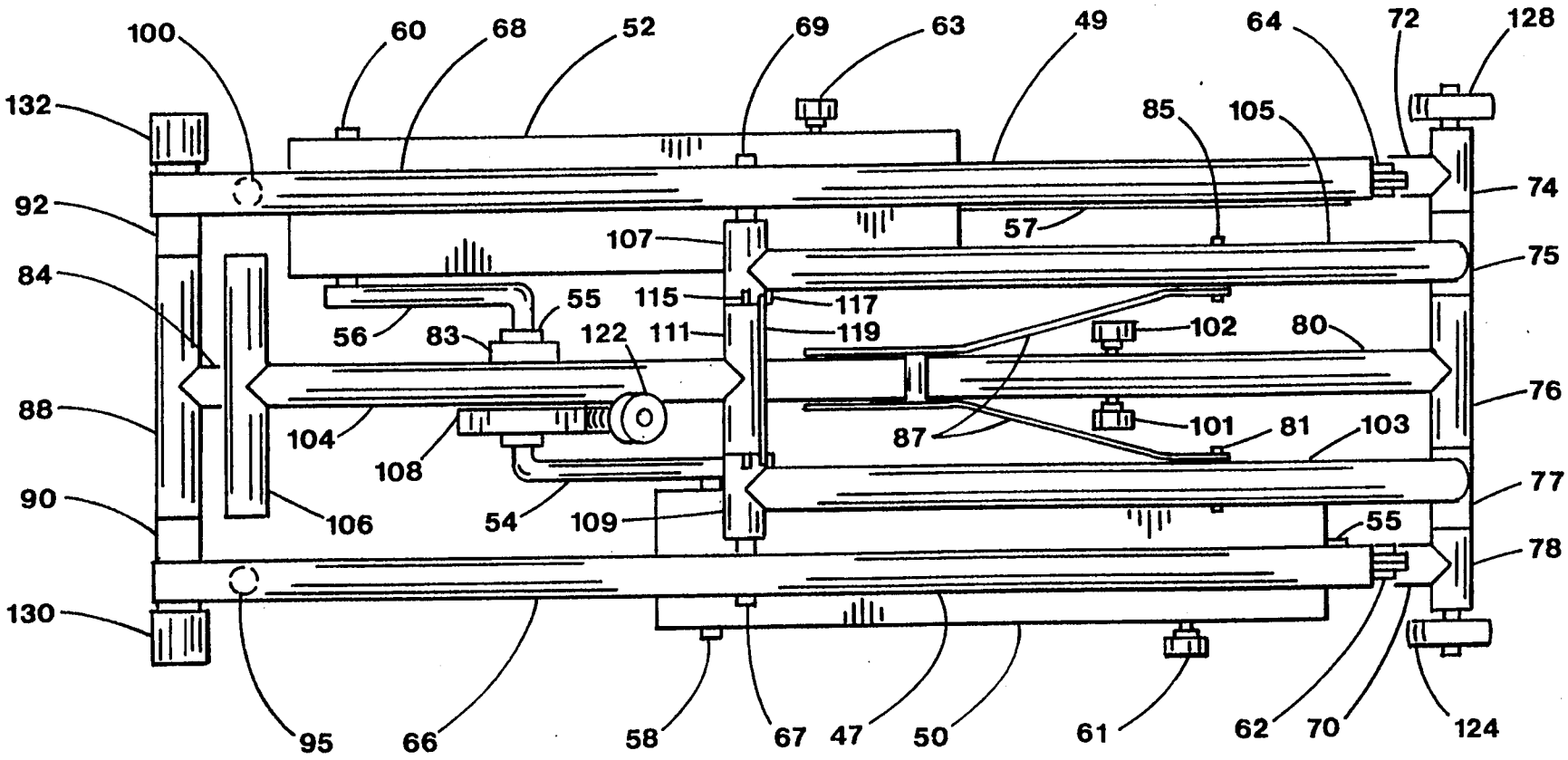
FIG. 3 is a top view of the preferred embodiment shown in FIG. 1 in the collapsed position.

Side support tubing 70 is welded to tubing 78 and telescopically connected to smaller tubing 94 which is welded to tubing 90. Similarly, side support tubing 72 is welded to tubing 74 and telescopically connected to smaller tubing 96 which is welded to tube 92. Frame tubing 90 and 92 shown in FIG. 3 are welded to a smaller diameter concentric tubing 98 while frame tubing 74 and 78 are welded to a similar smaller concentric tubing 73 (not shown). Tubing 76 is welded to frame tubing 80 but is free to rotate about concentric tube 73. Tubing 88 is welded to tube 84 and is also free to rotate about concentric tubing 98. Frame member 80 is welded to bearing housing 83 which is rotatably connected to frame tubing 84 at bolt joint 82.

Figure 5:
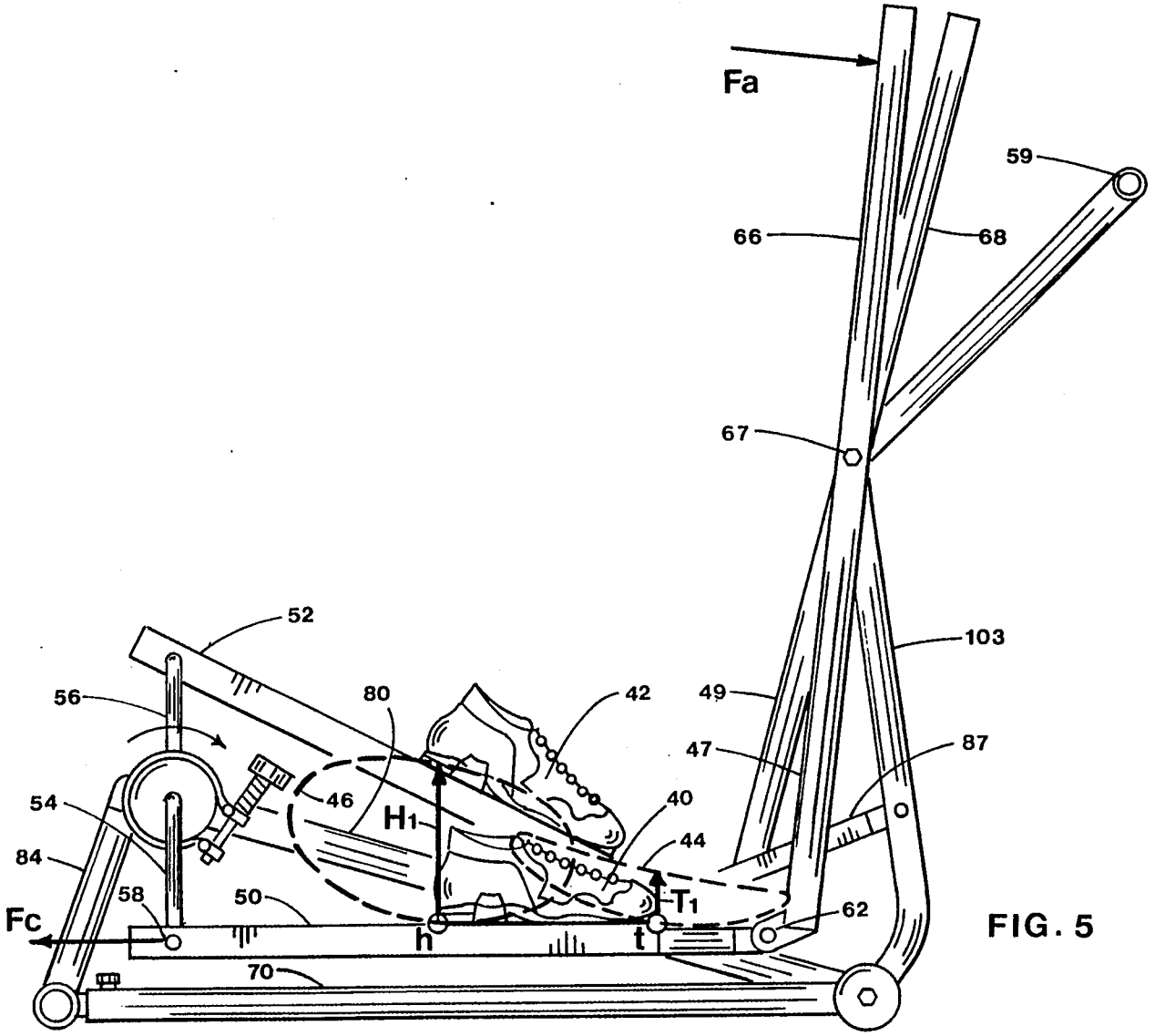
FIG. 5 is a right side elevation view of the preferred embodiment shown with the feet of the user forward on the elongate pedal and crank in a dead center position.

Foot position 40 and 42 are forward on elongate pedals 50 and 52 adjacent rockers 47 and 49 for the running mode shown in FIG. 5. The heel h of the foot traverses the curve 46 while the toe t traverses the path 44. H1 measures the height of the heel curve perpendicular to the elongate pedal in the lower most position while T1 measures the height of the toe curve in the same way. Handle 106 is not in use as position 59.

Figure 6:
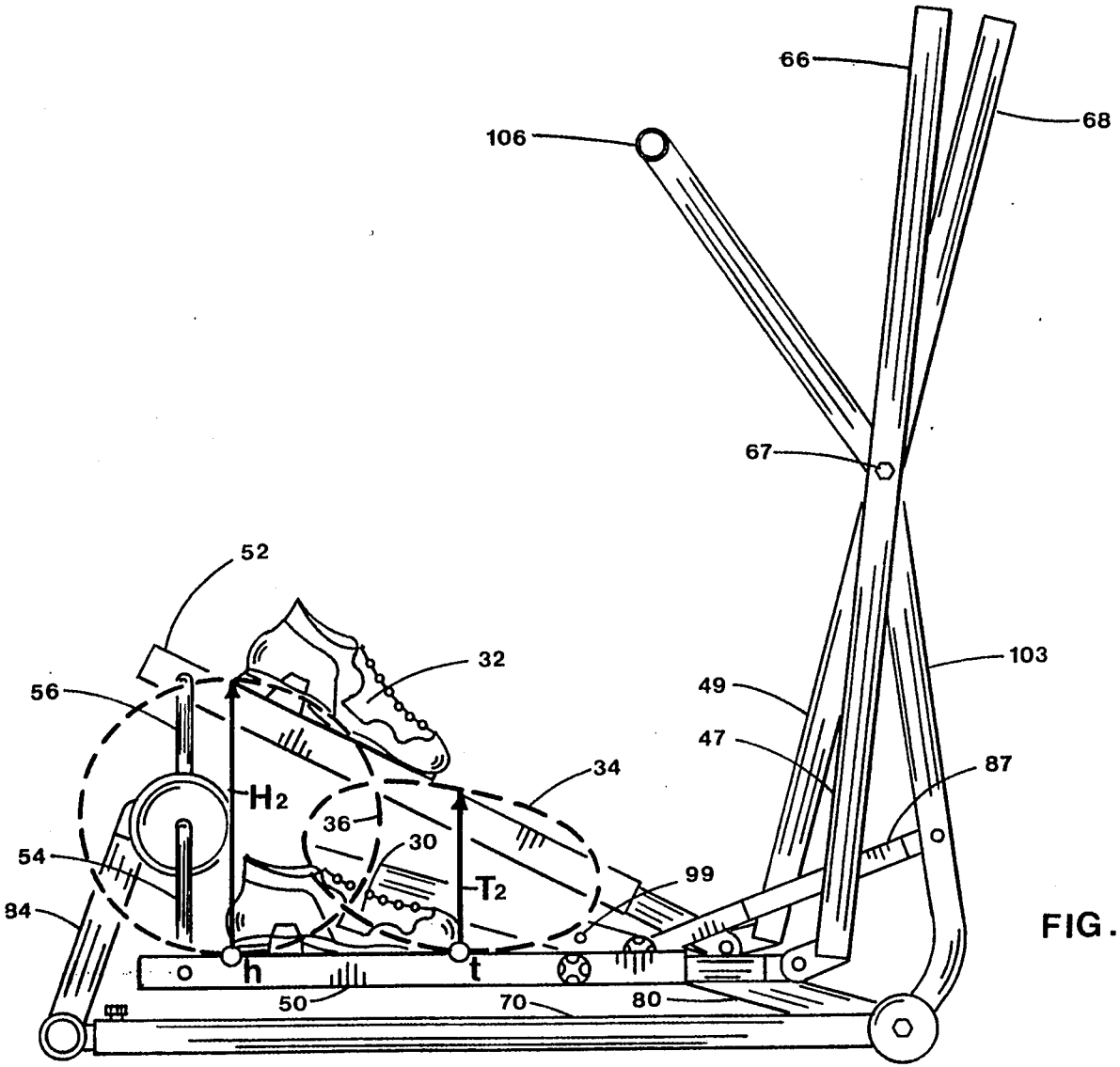
FIG. 6 is a right side elevation view of the preferred embodiment shown with the feet of the user rearward on the elongate pedal.

Foot positions 30 and 32 are rearward on elongate pedals 50 and 52 adjacent cranks 54 and 56 for the climbing mode shown in FIG. 6. The heel h of the foot traverses the curve 36 while the toe t of the foot traverses the curve 34. H2 and T2 measure the curve heights respectively. The handle 106 is in use for the climbing mode. Note that H2 is greater in length than H1 and T2 is greater in length that T1. Further, H is greater in length than T for both foot positions.

Referring again to FIG. 5, the force Fa exerted by the hand of the user is shown acting upon rocker arm extension 66 causing a torque about pivot 67 whereby this torque provides a force in the opposite direction in rocker arm 47 acting upon elongate pedal pivot 62 resulting in elongate pedal 50 providing force Fc impinging upon crank pivot 58 acting generally perpendicular to crank 54. The force Fc provides a torque upon the crank causing the crank 54 to move through the dead center position with the same general speed as in other positions. Rocker arm extension 68 acts upon crank 56 in a similar manner.

To collapse the exercise machine, pedals 50 and 52 are made generally parallel to cranks 54 and 56. Pedal locking screws 61 and 63 are loosened allowing rod pedal support 55 to slide into hollow pedal support 51 while rod pedal support 57 extends outward from hollow pedal support 53 allowing rocker arms 47 and 49 to become parallel with upright supports 103 and 105. It should be understood that rod pedal supports 55 and 57 can exchange roles depending upon the position of cranks 54 and 56.

Next, the baseframe is collapsed by loosening the frame locking screws 95 and 100 from tubes 94 and 96 allowing these tubes to telescopically extend outwardly from side support tubes 70 and 72. Tube 76 rotates on concentric tube 73, tube 88 rotates on concentric tube 98 while tube 84 rotates about bolt joint 82.

Next, the upright supports 103 and 105 and rocker arms 47 and 49 are made ready to fold by loosening the upright support brace locking screws 102 and 101, rotating upright support brace 87 about pivots 81 and 85 to become generally parallel to upright supports 103 and 105. The upright supports 103 and 105 and rocker arms 47 and 49 are then pivoted about concentric tube 73 until the assembly becomes generally parallel to side supports 70 and 72. Handle 106 and handle support 104 pivot at the cross member 111 about concentric tube 113 until both are generally parallel with side supports 70 and 72.

Brake drum 110 is fixed to crankshaft 55 and rotates with cranks 54 and 56. Brake band 108 is concentric to brake drum 110 and is attached at one end to frame 80 by bolt 117 which is common to spring stop 118. The other end of brake band 108 is connected to a threaded nut 114 by bolt 112. Nut 114 is connected to spring stop 118 by threaded rod 116 which has load adjustment knob 122 attached. Load spring 120 is concentric with rod 116 and compressed between knob 122 and spring stop 118. Clockwise rotation of knob 120 will increase spring compression to cause the brake band 108 to experience a closing force creating a frictional load on brake drum 110 as it rotates.

Figure 4:
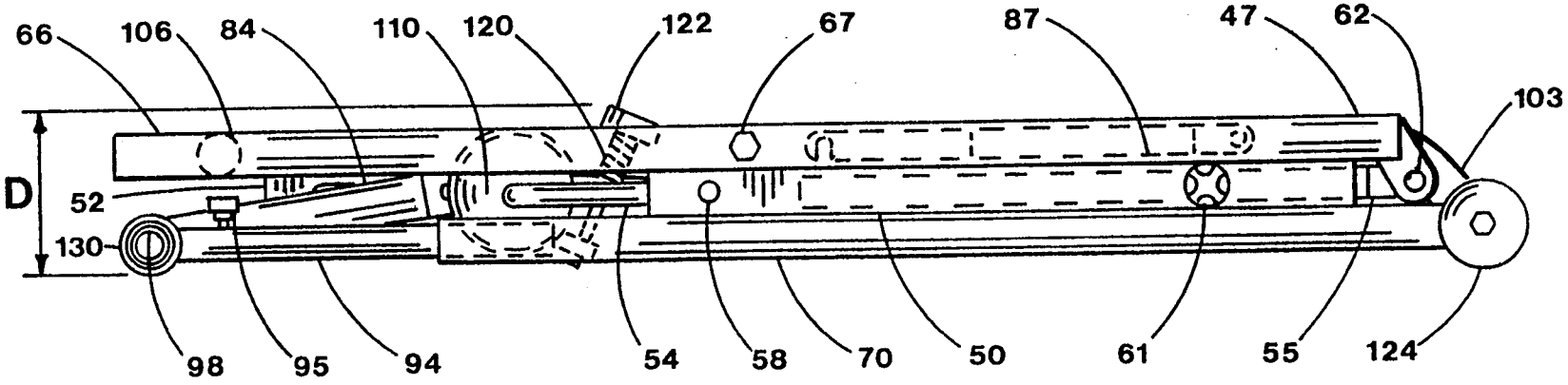
FIG. 4 is a side view of the preferred embodiment in the collapsed position shown in FIG. 3.

The collapsed exercise machine is shown in FIGS. 3 and 4 where frame tubes 80 and 84 are nearly parallel with side supports 70 and 72. Crank pins 58 and 60 are in contact with side supports 70 and 72 while telescoping tubes 94 and 96 are fully extended. Rocker arms 47 and 49 as well as rocker arm extensions 66 and 68 are in contact with and generally parallel to pedals 50 and 52. Handlebar support 104 is in contact with bearing housing 83 and generally parallel to side supports 70 and 72. Set-up of the exercise machine is essentially the reverse steps of the collapse procedure. The brake adjustment knob 122 and frame supports 130 and 132 define the space D containing all of the folded exercise machine. Floor support for the exercise machine is through rubber wheels 124 and 128 rotatably attached to tubing 73 and rubber supports 130 and 132 concentric with tubes 90 and 92. The collapsed machine is easily rolled about the apartment and under a bed with wheels 124 and 128 when tubes 90 and 92 are used as a handle.

What is claimed is:

1. A collapsible exercise machine comprising:

a pedal means, said pedal means having a pedal adjustable length means whereby a first pedal support member is operably associated with a second pedal support member to have adjustable distance between pedal support pivots;

a rocker means, said rocker means rotatably attached to the said second pedal support member on one end and rotatably connected to an upright support means;

an upright support means rotatably connected to said rocker means and pivotally connected to a frame and maintained rigid in one or more different positions relative to a frame during operation by a locking means;

a frame, said frame having a first support member and a second support member, whereby an adjustment means controls the position of said second support member relative to said first support member a third support member pivotally connected to said second support member, a fourth support member pivotally connected to said first support member at one end and rotatably connected to said third support member at the other end, a crankshaft bearing housing connected to said fourth support member and having a crank means projecting outwardly therefrom on both sides thereof, said first pedal support member connected to the end of each crank means, said second pedal support member being operably associated with said rocker means to allow said pedal means to move relative to said upright support means when the foot of the user is rotating said crank means and, a locking means on each pedal means maintaining said first pedal support members and said second pedal support members in fixed positions relative to each other until said locking means are released to allow said second pedal support members to move relative to said first pedal support members, whereafter said upright support locking means is released and said adjustment means is adjusted to collapse said exercise machine.

2. The pedal means according to claim 1 whereby said pedal adjustable length means comprises a hollow first pedal support member and a rod second pedal support member telescoped within said hollow first pedal support member.

3. The collapsible exercise machine of claim 1 wherein said collapsible exercise machine further includes a handle means comprising a tubular support member attached to a hand grip at one end and pivotally attached to said upright support member means adjacent the upper end of said upright support member means whereby said handle means is operably associated with and locked in place relative to said upright support member means until it is decided to collapse said exercise machine general to said.

4. The locking means of claim 1 operably associated with said upright support member means whereby said locking means comprises a brace member pivotally attached to said upright support member means and secured to said fourth support member using locking screws.

5. The upright support member means of claim 1 wherein said upright support means comprises tubular support members pivotally connected to said first support member on one end and pivotally attached to said rocker means on the other end wherein said tubular support members become parallel to said side support members when said locking means is released and the exercise machine is collapsed.

6. The rocker means of claim 1 wherein said rocker means comprises a tubular support member rotatably attached to said pedal means and rotatably attached to said upright support means whereby the tubular support member extends upward to provide arm exercise.

7. The collapsible exercise machine according to claim 1 further comprising an adjustable load resistance means.

8. The collapsible exercise machine according to claim 8 wherein the adjustable load resistance means is a friction brake operably coupled to said crank means and said fourth support member.

9. The collapsible exercise machine according to claim 3 having been dimensionally sized to accommodate an adult user whereby said collapsed exercise machine is contained between two parallel planes separated by a perpendicular distance of eight inches or less.

10. A collapsible exercise machine comprising:

a pedal means, said pedal means having a hollow pedal member and a rod pedal member telescoped within said hollow pedal member;

a rocker means, said rocker means rotatably attached to said rod pedal member on one end and rotatably connected to an upright support means whereby the other end of the said rocker means is available for arm exercise;

an upright support means rotatably connected to said rocker means and pivotally connected to a frame and maintained rigid in one or more different positions relative to a frame during operation by a locking means;

a frame, said frame having one or more side members, said side members having an adjustable length means, said side members connected on one end to a first support member and connected on the other end to a second support member, a third support member pivotally connected to said second support member, a fourth support member pivotally connected to said first support member at one end and rotatably connected to said third support member at the other end, a crankshaft bearing housing connected to said fourth support member and having a crank means projecting outwardly therefrom on both sides thereof, said hollow pedal member connected to the end of each crank means, said rod pedal member being operably associated with said rocker means to allow said pedal means to move relative to said upright support means when the foot of the user is rotating said crank means, the foot surface of said pedal means becomes generally parallel to said side members when the crank means is in the bottom position of rotation while the foot surface of said pedal means on the other side remains inclined and, a locking means on each pedal means maintaining said hollow pedal members and said rod pedal members in fixed positions until said locking means are released to allow said rod pedal members to slide relative to said hollow pedal members, whereafter said upright support locking means is released and said side member length is adjusted to collapse said exercise machine.

11. The adjustable length means of claim 10 wherein said adjustable length means comprises said side members each having a hollow member and a rod member telescoped within said hollow members.

12. The collapsible exercise machine of claim 10 wherein said collapsible exercise machine further includes a handle means comprising a tubular support member attached to a hand grip at one end and pivotally attached to said upright support member means adjacent the upper end of said upright support member means whereby said handle means is operably associated with and locked in place relative to said upright support member means until it is decided to collapse said exercise machine whereupon the said handle means becomes generally parallel to said side members when collapsed.

13. The locking means of claim 10 operably associated with said upright support member means whereby said locking means comprises a brace member pivotally attached to said upright support member means and secured to said fourth support member using locking screws.

14. The upright support member means of claim 10 wherein said upright support means comprises tubular support members pivotally connected to said first support member on one end and pivotally attached to said rocker means on the other end wherein said tubular support members become parallel to said side support members when said locking means is released and the exercise machine is collapsed.

15. The rocker means of claim 10 wherein said rocker means comprises a tubular support member rotatably attached to said pedal means and rotatably attached to said upright support means whereby the tubular support member extends upward to provide arm exercise.

16. The collapsible exercise machine according to claim 10 further comprising an adjustable load resistance means.

17. The collapsible exercise machine according to claim 16 wherein the adjustable load resistance means is a friction brake operably coupled to said crank means and said fourth support member.

18. The collapsible exercise machine according to claim 12 having been dimensionally sized to accommodate an adult user whereby said collapsed exercise machine is contained between two parallel planes separated by a perpendicular distance of eight inches or less.

19. The exercise machine according to claim 1 whereby said rocker means has rocker extension means for arm exercise;

whereby said crank means passes through dead center positions during said pedal cycle and said rocker arm extension means is phased relative to said dead center positions of said crank means such that the force of arm exercise impinging upon said rocker extension means provides torque upon said crank means during said dead center positions acting as a flywheel to maintain the crank motion with generally uniform speed during said pedal cycle.

* * * * *